US009376292B2

(12) United States Patent
Knecht et al.

(10) Patent No.: US 9,376,292 B2
(45) Date of Patent: Jun. 28, 2016

(54) MOBILE TELESCOPIC CRANE

(75) Inventors: Alexander Knecht, Zweibrucken (DE); Peter Kleinhans, Bubenreuth (DE); Tobias Ebinger, Lauf a. d. Pegnitz (DE); Andreas Hofmann, Kalchreuth (DE); Martin Lottes, Dormitz (DE)

(73) Assignee: TADANO FAUN GMBH, Lauf A.D. Pegnitz (DE)

( * ) Notice: Subject to any disclaimer, the term of this patent is extended or adjusted under 35 U.S.C. 154(b) by 248 days.

(21) Appl. No.: 13/994,383

(22) PCT Filed: Dec. 16, 2011

(86) PCT No.: PCT/EP2011/073024

§ 371 (c)(1),
(2), (4) Date: Aug. 9, 2013

(87) PCT Pub. No.: WO2012/080455

PCT Pub. Date: Jun. 21, 2012

(65) Prior Publication Data

US 2014/0158657 A1 Jun. 12, 2014

(30) Foreign Application Priority Data

Dec. 17, 2010 (DE) ..... 10 2010 063 456

(51) Int. Cl.

| | |
|---|---|
| ***B66C 23/04*** | (2006.01) |
| ***B66C 23/70*** | (2006.01) |
| ***B66C 23/36*** | (2006.01) |
| ***B66C 23/42*** | (2006.01) |

(52) U.S. Cl.

CPC ..... *B66C 23/701* (2013.01); *B66C 23/36* (2013.01); *B66C 23/42* (2013.01); *B66C 23/705* (2013.01); *B66C 23/708* (2013.01)

(58) Field of Classification Search

CPC ..... B66C 13/066; B66C 23/04; B66C 23/12; B66C 23/26; B66C 23/30; B66C 23/342; B66C 23/344; B66C 23/42; B66C 23/701; B66C 23/705

USPC ..... 212/348, 350

See application file for complete search history.

(56) References Cited

U.S. PATENT DOCUMENTS 3,802,136 A 4/1974 Eiler et al.
6,726,437 B2 * 4/2004 Albright et al. ..... 414/728

(Continued)

FOREIGN PATENT DOCUMENTS

EP 1354842 A2 10/2003
GB 2387373 A 10/2003

(Continued)

OTHER PUBLICATIONS

Search Report DE 10 2010 063 456.5; dated: Sep. 22, 2011; 5 pages.

(Continued)

*Primary Examiner* — Emmanuel M Marcelo
(74) *Attorney, Agent, or Firm* — Reising Ethington P.C.

(57) ABSTRACT

A mobile telescopic crane has a telescopic jib with at least four part-jibs. Each of the part-jibs is constructed from at least two part-jib portions so as to be telescopic in a longitudinal direction. Part-jib portions arranged at a spacing from one another transverse to the longitudinal direction each form a jib portion with at least one flexurally rigid connecting element. A construction of this type of the jib means that an increase in the bearing load is easily achieved by increasing the area moment of inertia of the jib.

24 Claims, 15 Drawing Sheets

(56) References Cited

U.S. PATENT DOCUMENTS

| | | | | |
|---|---|---|---|---|
| 8,234,823 | B2 * | 8/2012 | McClure et al. | 52/111 |
| 2003/0079883 | A1 | 5/2003 | McCulloch et al. | |
| 2011/0272375 | A1 * | 11/2011 | Willim | 212/273 |
| 2015/0008206 | A1 * | 1/2015 | Knecht et al. | 212/299 |

FOREIGN PATENT DOCUMENTS

| | | | |
|---|---|---|---|
| JP | 4728652 | | 11/1972 |
| JP | 56023195 | A | 3/1981 |
| JP | 1121088 | A | 1/1999 |
| RU | 2106295 | C1 | 3/1998 |
| WO | 2011006420 | A1 | 1/2011 |
| WO | 2011087398 | A1 | 7/2011 |

OTHER PUBLICATIONS

Japenese Patent Office Action dated Aug. 18, 2015.

* cited by examiner

MOBILE TELESCOPIC CRANE

CROSS-REFERENCES TO RELATED APPLICATIONS

This application claims the priority of German Patent Application, Serial No. 10 2010 063 456.5, filed Dec. 17, 2010, and International Application PCT/EP2011/073024 filed Dec. 16, 2011, pursuant to 35 U.S.C. 119(a)-(d), the content of which is incorporated herein by reference in its entirety as if fully set forth herein.

FIELD OF THE INVENTION

The invention relates to a mobile telescopic crane with a movable undercarriage, a superstructure rotatably arranged on the undercarriage, and a jib, which is telescopic in a longitudinal direction, arranged on the superstructure and is pivotable in a luffing plane.

BACKGROUND OF THE INVENTION

A mobile telescopic crane is known from EP 1 354 842 A2, which has two anchoring supports arranged on the jib and inclined with respect to the luffing plane. The anchoring supports are connected to the free end of the jib and the superstructure to increase the bearing load of the mobile telescopic crane by means of anchoring cables. As a result, loads acting laterally on the jib, which may be the bearing load-limiting criterion in an operating position of the jib, can be better absorbed. The drawback in this mobile telescopic crane is that the anchoring supports represent a substantial additional weight. The anchoring supports therefore have to be transported separately on a lorry to the construction site and assembled there on the jib. This is linked with a substantial outlay with respect to costs and time.

A material handling machine is known from GB 2 387 373 A, which has a movable machine frame and a jib, which is pivotably arranged thereon and telescopic. The jib is constructed from a plurality of jib portions, a receiving fork for a load to be moved being arranged on the outermost jib portion. The jib portions are telescopic, so the jib can be extended and retracted in order to move the receiving fork with the load arranged thereon toward the machine frame and away from it. In order to reduce the tilting moment about a front axle of the material handling machine, at least one jib portion is produced from a composite material. As a result, the weight of the jib and therefore the tilting moment about the front axle is reduced. The outermost jib portion is, for example, constructed from three part-jib portions made of composite material.

SUMMARY OF THE INVENTION

The invention is based on an object of providing a mobile telescopic crane, which easily allows an increase in the bearing load.

This object is achieved by a mobile telescopic crane, in which the telescopic jib has at least four part-jibs, in which each of the part-jibs is constructed from at least two part-jib portions so as to be telescopic in the longitudinal direction, and in which part-jib portions arranged at a spacing from one another transverse to the longitudinal direction each form a jib portion with at least one flexurally rigid connecting element. Since the jib is constructed from at least three part-jibs arranged spaced apart from one another and flexurally rigidly connected to one another, the area moment of inertia of the jib is significantly increased. The area moment of inertia, which is a measure of the flexural rigidity, is produced according to the parallel axes theorem from the part-jibs' own proportions and their Steiner proportions. Owing to the flexurally rigid connecting elements, which connect the part-jib portions of the part-jibs into the jib portions, the jib is extremely flexurally rigid, so the cross-sectional area remains substantially level when the jib is loaded, so the Steiner proportions can be set when calculating the area moment of inertia substantially with their theoretical values, optionally by reduction ratios.

Owing to the at least four part-jibs, a high degree of rigidity of the jib is ensured both with respect to bending forces acting perpendicular to the luffing plane and also in the luffing plane. The at least four part-jibs may be arranged polygonally, the rigidity being adjustable over the width and height of the jib with respect to bending forces acting perpendicular to the luffing plane and in the luffing plane. For example, the at least four part-jibs may be arranged triangularly or quadrilaterally, in particular rectangularly, trapezoidally or rhombically. This applies when the jib has precisely four or more than four jibs.

Because of the significant increase in the area moment of inertia or area moments of inertia, the jib according to the invention can be dimensioned completely differently from conventional jibs, so that in comparison to a conventional jib with anchoring supports, a corresponding increase in the bearing load can be achieved with a lower additional weight. Since the part-jibs are constructed from part-jib portions that are telescopic in the longitudinal direction, the jibs can be brought from a transporting position into an operating position with less effort. Owing to the lower additional weight, the mobile telescopic crane according to the invention—within a certain bearing load class—can travel with the complete jib to the construction site in the public road traffic, so no separate transportation and no laborious assembly are necessary in contrast to a jib with anchoring supports. The mobile telescopic crane according to the invention therefore easily allows an increase in the bearing load.

Moreover, the jib according to the invention can be dimensioned in such a way that, in comparison to a conventional jib with anchoring supports, a substantial increase in the bearing load can again be achieved. In this case, the jib according to the invention also has a substantial weight, so the mobile telescopic crane with the jib according to the invention can possibly no longer unrestrictedly take part in public road traffic. Individual part-jibs or a group of part-jibs or the entire jib then have to be transported separately to the construction site and assembled there. In the described dimensioning of the jib according to the invention, the advantage therefore lies in the increase in the bearing load.

A large number of optimizing parameters are provided by the number of part-jibs and their arrangement and spacing with respect to one another, so the jib according to the invention can be optimized with respect to its flexural rigidity perpendicular to and/or parallel to the luffing plane and/or with respect to weight. Depending on in which bearing load class the mobile telescopic crane according to the invention is to be, the jib according to the invention can be optimized with respect to its weight and/or with respect to its flexural rigidity or bearing load. The mobile telescopic crane according to the invention preferably has a jib with at least three, in particular at least four, and in particular at least five jib portions or respective part-jib portions.

A mobile telescopic crane, in which the jib, perpendicular to the luffing plane, has a cross-sectional area $A_A$ produced by the at least four part-jibs and each of the part-jibs, perpendicular to the luffing plane, has a part-cross-sectional area, wherein there applies to a ratio of the cross-sectional area $A_A$ to a sum $A_S$ of the part-cross-sectional areas: $A_A/A_S>1$, in particular $A_A/A_S\geq1.5$, in particular $A_A/A_S\geq2$, and, in particular $A_A/A_S\geq2.5$, ensures a high degree of rigidity of the jib with respect to bending loads. The respective part-cross-sectional area comprises the material cross-sectional area and the cavity cross-sectional area limited by the material of the part-jib.

A mobile telescopic crane, in which the jib, perpendicular to the luffing plane, has a width $B_A$ and each of the part jibs has a width $B_i$, to the ratio of which there applies, in each case: $B_A/B_i\geq1.5$, in particular $B_A/B_i\geq2$, and, in particular $B_A/B_i\geq2.5$, has an increased rigidity with respect to bending forces acting perpendicular to the luffing plane. The width $B_A$ is a maximum width of the jib or the respective jib portion.

A mobile telescopic crane, in which the jib, parallel to the luffing plane, has a height $H_A$ and each of the part-jibs has a height $H_i$, to the ratio of which there applies, in each case: $H_A/H_i\geq1.5$, in particular $H_A/H_i\geq2$, and in particular $H_A/H_i\geq2.5$, has an increased rigidity with respect to bending forces acting on the luffing plane. The height $H_A$ is a maximum height of the jib or the respective jib portion.

A mobile telescopic crane, in which the part-jibs are arranged symmetrically with respect to the luffing plane, ensures the same rigidity behavior of the jib in the positive and negative lateral direction.

A mobile telescopic crane, in which the part-jibs are arranged polygonally, in particular triangularly or quadrilaterally with respect to one another, allows the rigidity of the jib to be optimized in relation to its weight. With a quadrilateral arrangement of the part-jibs, they may be arranged, in particular, as a rectangle, trapezium, rhombus or kite.

A mobile telescopic crane, in which at least one part jib is displaceable to change the cross-sectional area $A_A$, in particular to change a height $H_A$ of the jib, with respect to at least one other part-jib, ensures a compact transporting position of the jib. Owing to the possible change in the height of the jib, when necessary, it is, in particular, ensured that the mobile telescopic crane does not exceed a maximally permissible height during travelling operation. The at least four part-jibs may, for example, be linearly movable or pivotable relative to one another. The part-jibs can be fixed with respect to one another in a displaced operating position. This takes place, in particular, by means of mechanical locking units. The mechanical locking units are, for example, arranged on the connecting elements.

A mobile telescopic crane, in which respective adjacent part-jib portions are mechanically lockable with respect to one another in the longitudinal direction, in the extended operating position of the jib, ensures a high degree of rigidity owing to the mechanical locking of respective adjacent jib portions, as the part-jibs constructed from the part-jib portions are extremely flexurally rigid because of the locking. Respective adjacent part-jib portions of each part-jib are preferably mechanically lockable with respect to one another. The locking takes place, for example, by means of locking bolts, which can be actuated hydraulically, pneumatically or electromechanically. Alternatively, the locking can take place by means of a bayonet-like locking mechanism.

A mobile telescopic crane, in which the part-jib portions of all the part jibs are configured as hollow cylinders and adjacent part-jib portions are in each case telescopeable into one another, ensures a telescopic ability of the part-jibs. Since part jib portions that are adjacent in the longitudinal direction can be telescoped into one another, in each case, or are guided telescopically, a telescopic ability of the jib portions in conjunction with a high degree of rigidity of the jib is easily achieved.

A mobile telescopic crane, in which the part-jib portions of all the part-jibs have a geometrically similar and, in particular, an identical cross-section, is simply constructed. For example, the part-jib portions have a circular cross-section.

A mobile telescopic crane, in which respective adjacent part-jib portions of all the part-jibs are mechanically lockable with respect to one another in the longitudinal direction, ensures a high degree of rigidity of the jib, so the cross-sectional area remains level when the jib is loaded and the Steiner proportions when calculating the area moment of inertia can be set approximately with their theoretical values.

A mobile telescopic crane, in which at least two adjacent part-jib portions are mechanically lockable with respect to one another by means of at least one locking bolt, easily allows a mechanical locking of adjacent part jib portions. The respective locking bolt can be actuated, for example, hydraulically, pneumatically or electromechanically. All the adjacent part-jib portions of each part-jib are preferably mechanically lockable with respect to one another by means of at least one locking bolt.

A mobile telescopic crane, in which at least two adjacent part-jib portions are mechanically lockable with respect to one another by means of at least two locking bolts, allows a rapid mechanical locking of adjacent part jib portions. Each locking bolt has to be guided only through two associated locking bores of the adjacent part-jib portions in order to mechanically lock them with respect to one another. The path of the respective locking bolt covered for locking is small. Since the respective locking bolt only has to be guided through two associated locking bores, a comparatively low and accuracy is necessary when aligning the respective locking bolt. Precisely two locking bolts are preferably provided, which are arranged opposing one another and can be actuated in opposing directions.

A mobile telescopic crane, in which the jib has a width that changes perpendicular to the luffing plane, the width increasing proceeding from at least one lower part jib facing the undercarriage up to at least two upper part-jibs remote from the undercarriage, ensures a high degree of rigidity with respect to bending forces acting perpendicular to the luffing plane. If the at least two part-jibs with the largest spacing from the luffing plane were arranged on a lower side of the jib facing the undercarriage so that the width of the jib decreased proceeding from the lower side thereof to the upper side thereof, the at least two lower part-jibs would be subjected to pressure both because of the bending forces acting in the luffing plane and also because of bending forces acting perpendicular to the luffing plane. A construction of this type of the jib would lead to an undesired bearing load limitation of the jib or the mobile telescopic crane because of the double pressure loading in accordance with Euler's buckling cases. In order to avoid this, the at least two part-jibs with the greatest spacing from the luffing plane are arranged on the side or the upper side of the jib remote from the undercarriage, so bending forces acting in the luffing plane substantially lead to a tensile loading of the at least two upper part-jibs, whereas bending forces acting perpendicular to the luffing plane lead to a pressure loading of one of the upper part-jibs. The pressure loading on the part-jibs spaced farthest apart from the luffing plane can therefore be significantly reduced. The area moment of inertia is thus, on the one hand, increased in the manner according to the invention, but, on the other hand, a double pressure loading is avoided. Owing to the width, which increases in the direction of the upper side, an optimal flexural rigidity of the jib is thus achieved with respect to bending forces acting perpendicular to the luffing plane. As the installation space in the transporting position of the jib is substantially not limited on the upper side, the width of the jib on the upper side can be dimensioned within broad ranges, as required. If the job has precisely four part-jibs, which are arranged triangularly, a lower part-jib facing the undercarriage is arranged in the luffing plane and three upper part-jibs remote from the undercarriage are arranged spaced apart from the luffing plane or in the luffing plane, so the width of the jib increases proceeding from the lower part-jib or the lower side to the upper part-jibs or the upper side. If the jib has precisely four part-jibs, which are arranged trapezoidally, the width of the jib increases proceeding from two lower part-jibs facing the undercarriage to two upper part-jibs remote from the undercarriage. The lower part-jibs therefore have a smaller spacing from the luffing plane than the upper part-jibs. As the pressure loading decreases with the spacing from the luffing plane because of bending forces acting perpendicular to the luffing plane, the flexural rigidity is also optimized with respect to bending forces acting perpendicular to the luffing plane in a jib with part-jibs arranged trapezoidally.

The same applies when precisely four part-jibs are arranged in the form of a rhombus or a kite. In the arrangement of the part-jibs as a rhombus or kite, the width of the jib increases proceeding from a lower part-jib arranged in the luffing plane to two upper part-jibs arranged spaced apart from the luffing plane, so the described advantages are achieved. The upper part-jib arranged in the luffing plane is not subjected to pressure both because of bending forces acting in the luffing plane and because of bending forces acting perpendicular to the luffing plane. A reduction in the width of the jib proceeding from the upper part-jibs arranged spaced apart from the luffing plane to the upper part-jib arranged in the luffing plane is therefore not disadvantageous.

A mobile telescopic crane, in which respective adjacent part-jib portions of at least one part-jib is mechanically lockable with respect to one another at the end, in particular the at least one locking bolt provided in each case to lock adjacent part-jib portions being arranged on the associated connecting element, ensures a high degree of rigidity of the jib relative to bending forces acting in the luffing plane. Owing to the end locking of adjacent part-jib portions, bending forces acting laterally are guided away directly into the entire jib and absorbed thereby. This is ensured, in particular, in that the respective at least one locking bolt is fastened or displaceably mounted directly on the associated or adjacent connecting element.

A mobile telescopic crane, in which at least one lower part-jib facing the undercarriage has a larger part-cross-sectional area in comparison to the further part-jibs, ensures a high degree of flexural rigidity relative to bending forces acting in the luffing plane. The at least one part-jib facing the undercarriage can absorb high bending forces acting in the luffing plane because of its part-cross-sectional area. The flexural rigidity of the jib is therefore correspondingly high. The part-cross-sectional area of the at least one lower part-jib in each case corresponds at least to one and a half times, and at least twice the part-cross-sectional area, of the further part-jibs. The further part jibs preferably have the same part-cross-sectional areas. In addition, the at least one part-jib facing the undercarriage can be used as a receiving space for the hydraulic cylinder to telescope the jib.

A mobile telescopic crane, in which at least one part-jib forms a receiving space, in which a hydraulic cylinder is arranged to telescope the jib, allows a telescopic ability of the jib in a simple and space-saving manner. The at least one part-jib preferably has a larger part-cross-sectional area in comparison to the further part-jibs. If at least one part-jib is arranged in the luffing plane, the hydraulic cylinder is preferably arranged in this part-jib. If all the part-jibs are arranged spaced apart from the luffing plane, a hydraulic cylinder is preferably arranged in one of the part-jibs. Alternatively, a plurality of hydraulic cylinders, preferably two hydraulic cylinders, may be arranged in part-jibs, which are arranged symmetrically to the luffing plane.

A mobile telescopic crane, in which the jib has precisely four part-jibs, which are arranged polygonally and symmetrically with respect to the luffing plane, has a comparatively rigid and simply constructed jib.

A mobile telescopic crane, in which the part-jibs limit a cable guide channel, allows a simple and space-saving cable guidance.

A mobile telescopic crane, in which a support cable is guided along the jib, the support cable being arranged, in particular, in the cable guide channel, in the conventional manner ensures the lifting of loads by means of a support cable. The support cable is guided from a free end of the jib to a cable winch arranged on the superstructure. The support cable is preferably guided in the cable guide channel.

Further features, advantages and details of the invention emerge with the aid of the following description of a plurality of embodiments.

DESCRIPTION OF THE PREFERRED EMBODIMENTS

Figure 1:
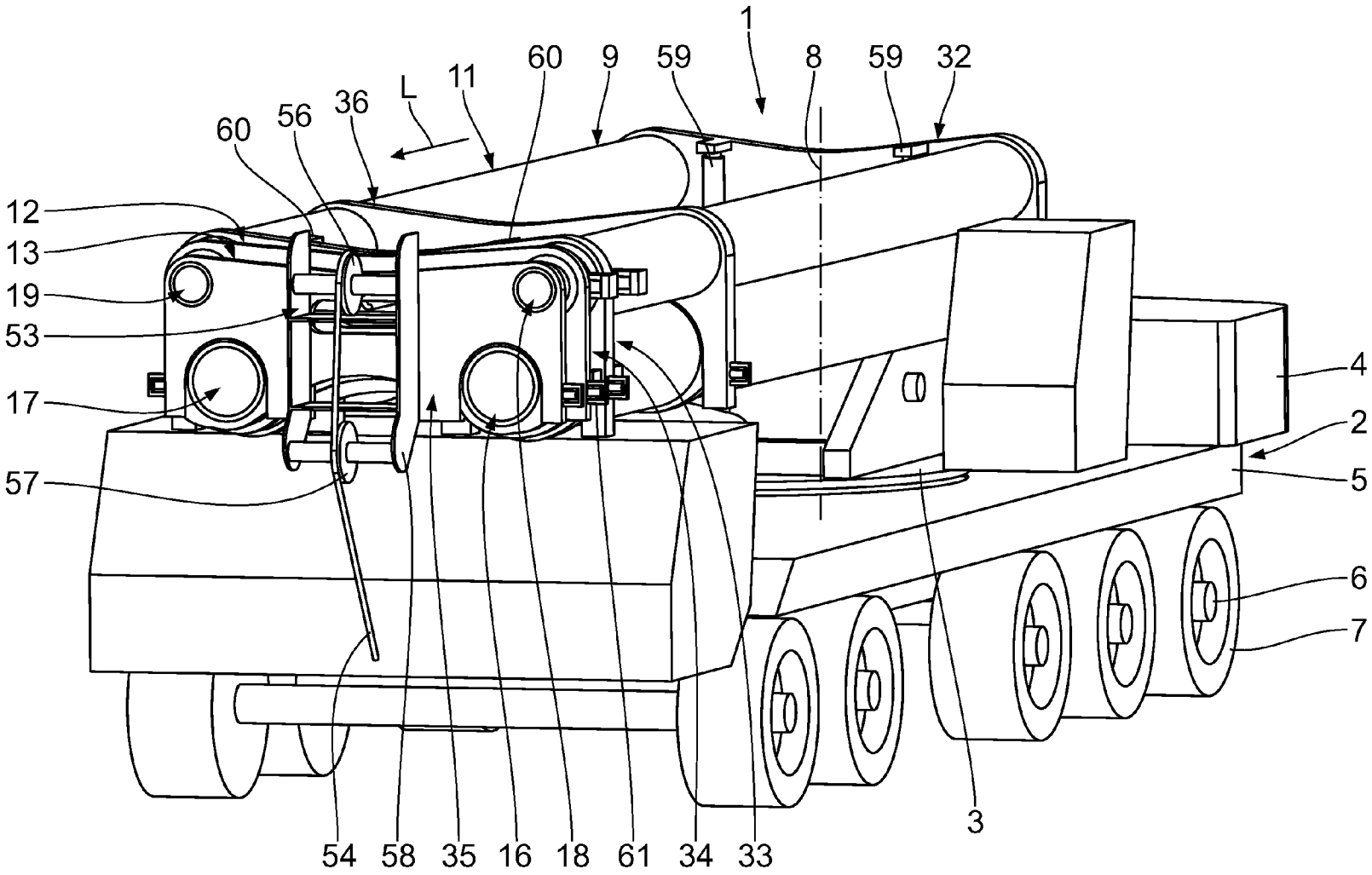
FIG. 1 shows a perspective view of a mobile telescopic crane according to a first embodiment with a telescopic jib, which is constructed from four part-jibs and is located in a transporting position.

A first embodiment of the invention will be described below with reference to FIGS. 1 to 6. A mobile telescopic crane 1 has a movable undercarriage 2, on which a superstructure 3 with a counter-weight 4 is arranged. The undercarriage 2 is configured in the conventional manner for travelling operation on public roads. For this purpose, the undercarriage 2 has a base frame 5, on which a plurality of axles 6 with wheels 7 arranged thereon, which can be driven and steered in the conventional manner, are mounted. The superstructure 3 and the counter-weight 4 arranged thereon are rotatably mounted on the undercarriage 2 about a rotational axis 8 running perpendicular to the base frame 5.

Arranged on the superstructure 3 is a jib 9, which can be pivoted by means of a hydraulic cylinder 10 in a luffing plane W and is telescopic in a longitudinal direction L. The jib 9, for this purpose, has three jib portions 11 to 13, which can be retracted and extended telescopically by means of a hydraulic cylinder 14 and can thus be transferred from a retracted transporting position into an extended operating position. The first jib portion 11 is pivotably articulated to the superstructure 3 about a horizontal pivot axis 15 at the end. The jib 9 is pivoted in the luffing plane W by means of the hydraulic cylinder 10, which, proceeding from the superstructure 3 is articulated to the jib portion 11 spaced apart from the pivot axis 15.

The jib 9 has four part-jibs 16, 17, 18, 19, which are in each case constructed telescopically from three part-jib portions 20 to 22, 23 to 25, 26 to 28 and 29 to 31. The hydraulic cylinder 14 is arranged within a receiving space of the part-jib 16, which is configured as a hollow cylinder to configure the receiving space. Alternatively or additionally, a hydraulic cylinder 14 may be arranged within a receiving space of the part-jib 17, which is configured as a hollow cylinder to configure the receiving space. The part-jibs 16 to 19 are arranged transversely to the longitudinal direction L at a spacing from one another and connected to one another by four flexurally rigid connecting elements 32 to 35. The connecting elements 32 and 33 are in each case arranged on the part jib portions 20, 23, 26 and 29 at the end and form therewith the first jib portion 11. The connecting element 34 is in turn arranged on the end of the part-jib portions 21, 24, 27 and 30 remote from the first jib portion 11 and forms therewith the second jib portion 12. Accordingly, the connecting element 35 is arranged on an end of the part-jib portions 22, 25, 28 and 31 remote from the jib portion 12 and forms therewith the third jib portion 13. A further connecting 36 is arranged on the part-jib portions 20, 23, 26 and 29 and between the connecting elements 32 and 33. The hydraulic cylinder 10 is pivotably articulated to the connecting element 36.

The jib 9 is constructed symmetrically with respect to the luffing plane W and has a jib centre longitudinal axis 37 called a centroidal axis and located in the luffing plane W. The part-jibs 16 to 19 correspondingly have associated part-jib centre longitudinal axes 38 to 41, which are arranged polygonally or quadrilaterally and symmetrically with respect to the luffing plane W. The part-jib centre longitudinal axes 38 to 41 are, in particular, arranged trapezoidally. The jib centre longitudinal axis 37 lies in the luffing plane W. The part jib centre longitudinal axes 38, 39 have the same spacings $b_1$ and $b_2$ perpendicular to the luffing plane W and the same spacings $h_1$ and $h_2$ with respect to the jib centre longitudinal axis 37 parallel to the luffing plane W. Accordingly, the part jib centre longitudinal axes 40, 41 have the same spacings $b_3$ and $b_4$ perpendicular to the luffing plane W and the same spacings $h_3$ and $h_4$ with respect to the jib centre longitudinal axis 37 parallel to the luffing plane W. Because of the trapezoidal arrangement of the part jib 16 to 19, there applies to the spacings $b_1=b_2<b_3=b_4$.

Figure 7:
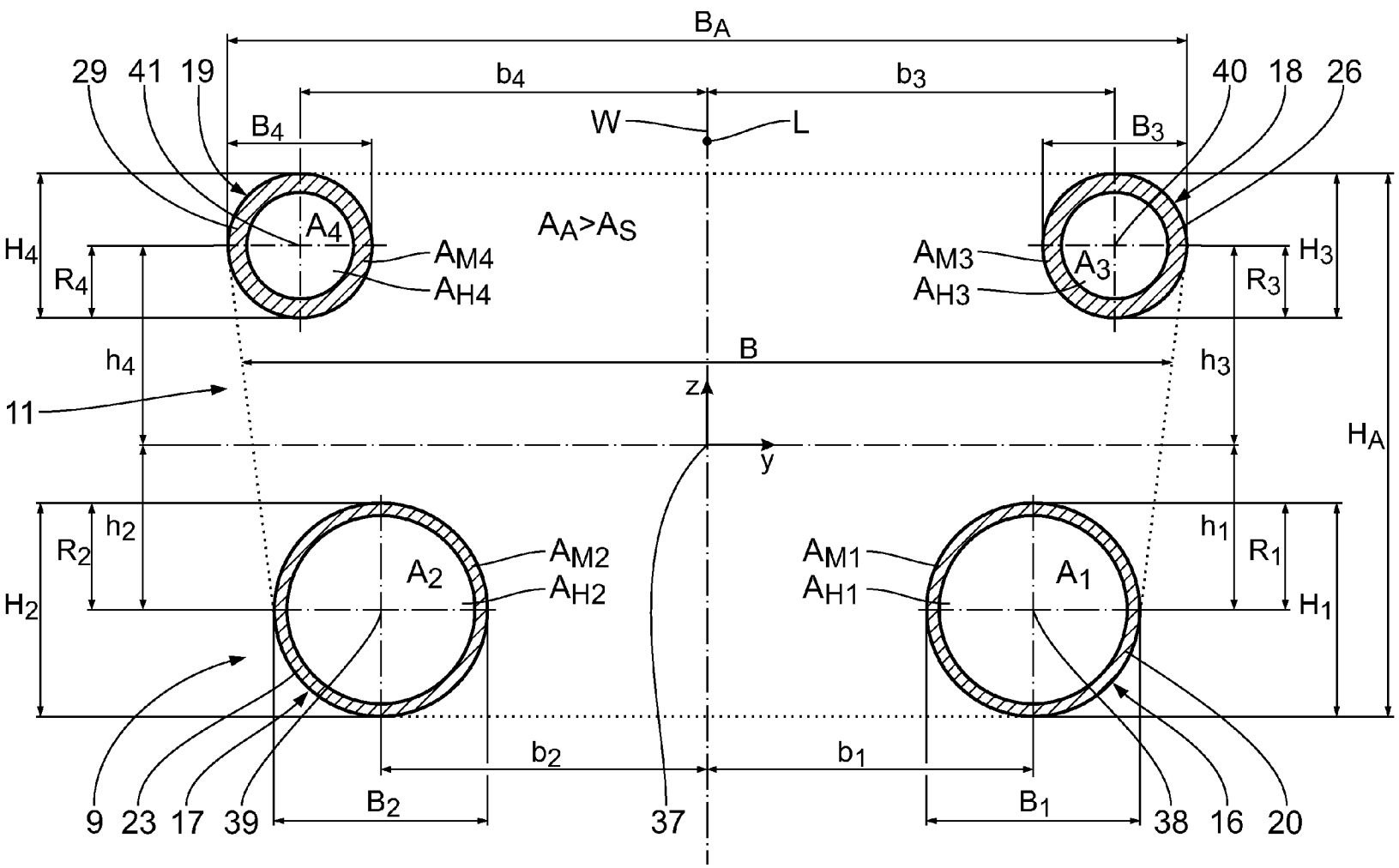
FIG. 7 shows a cross-section through the jib along the section line VII-VII in FIG. 5.
Figure 8:
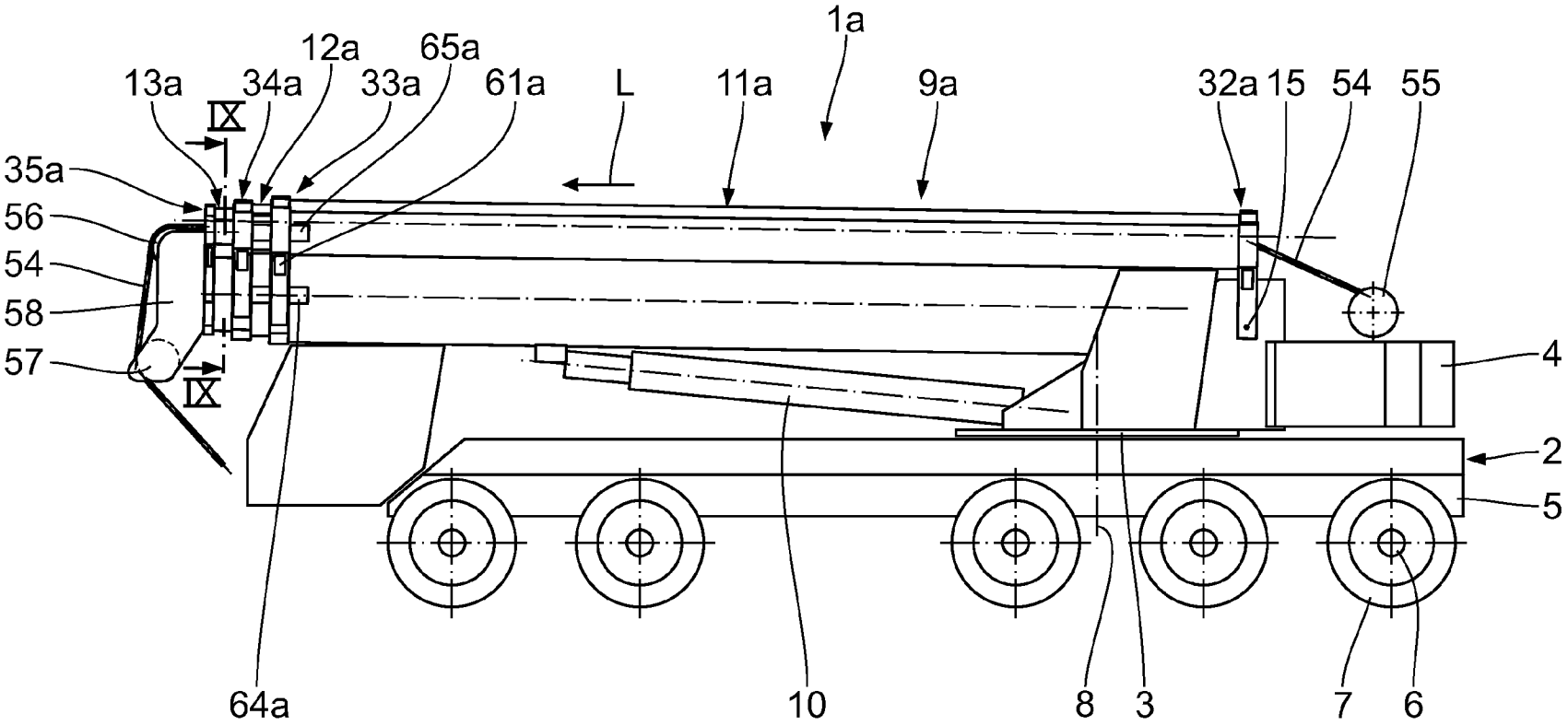
FIG. 8 shows a side view of a mobile telescopic crane according to a second embodiment with a jib, which is constructed from four part-jibs and is in a transporting position.
Figure 9:
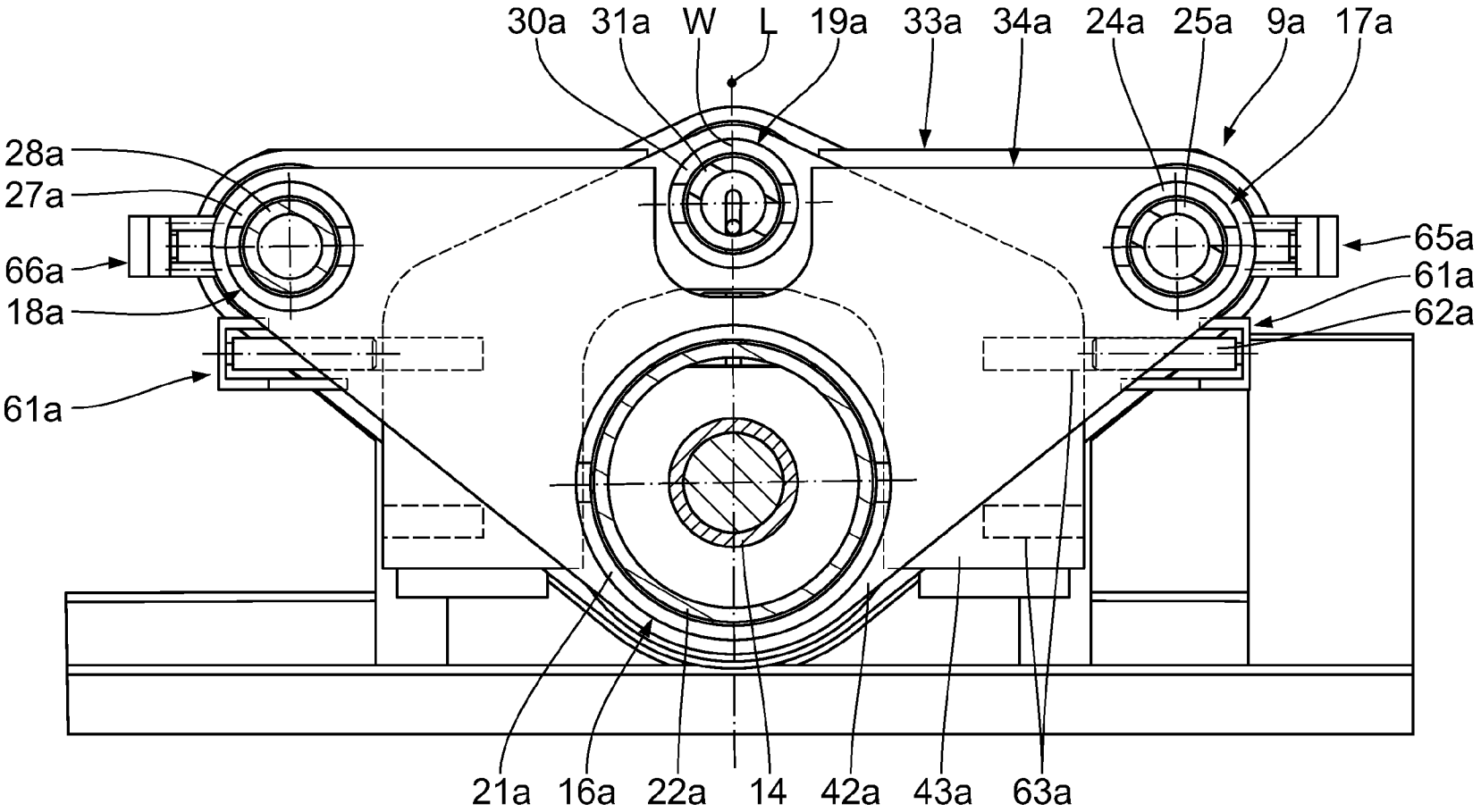
FIG. 9 shows a cross-section through the jib along the section line IX-IX in FIG. 8.
Figure 10:
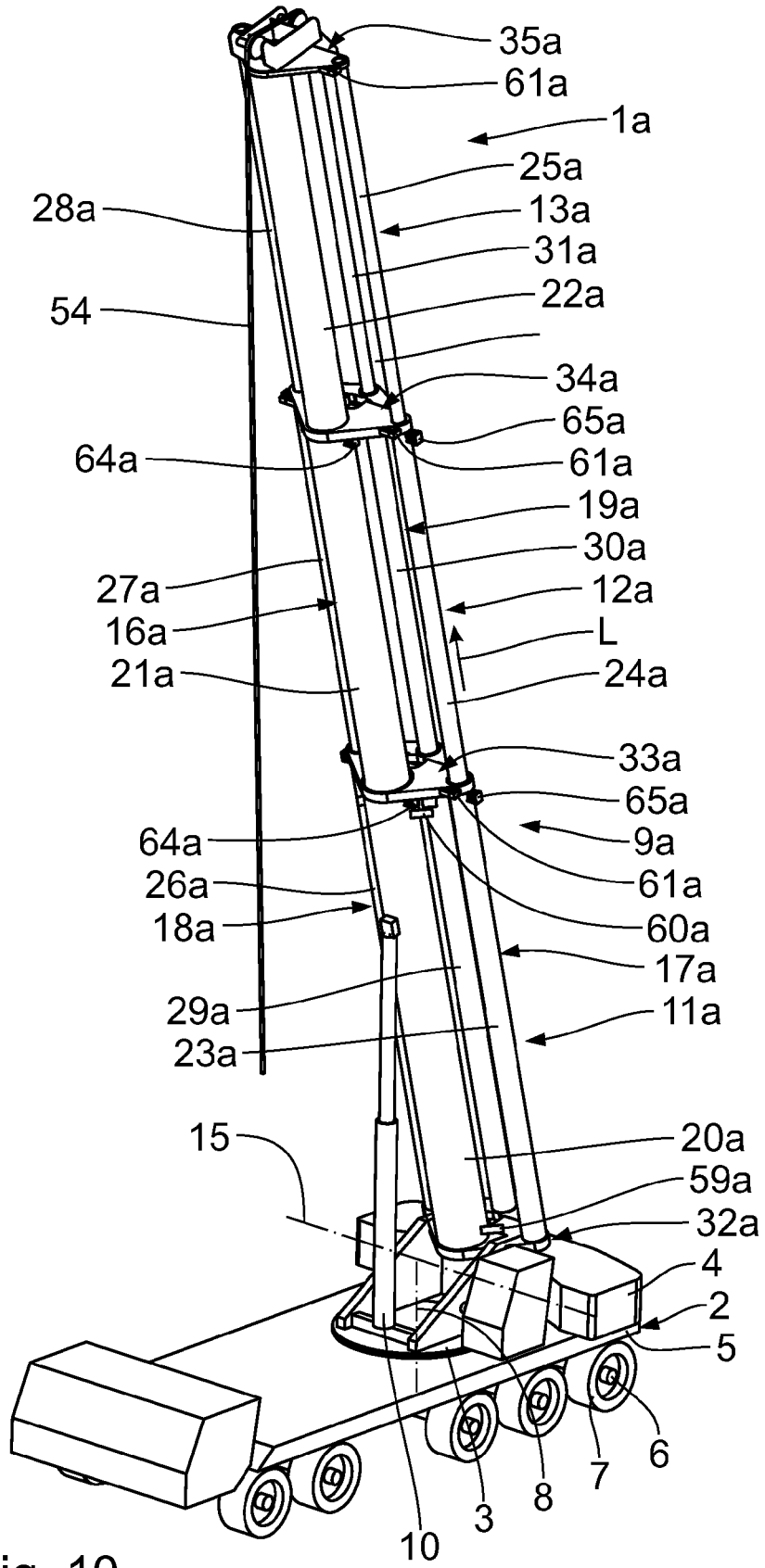
FIG. 10 shows a perspective view of the mobile telescopic crane in FIG. 8 with the jib in an extended operating position.
Figure 11:
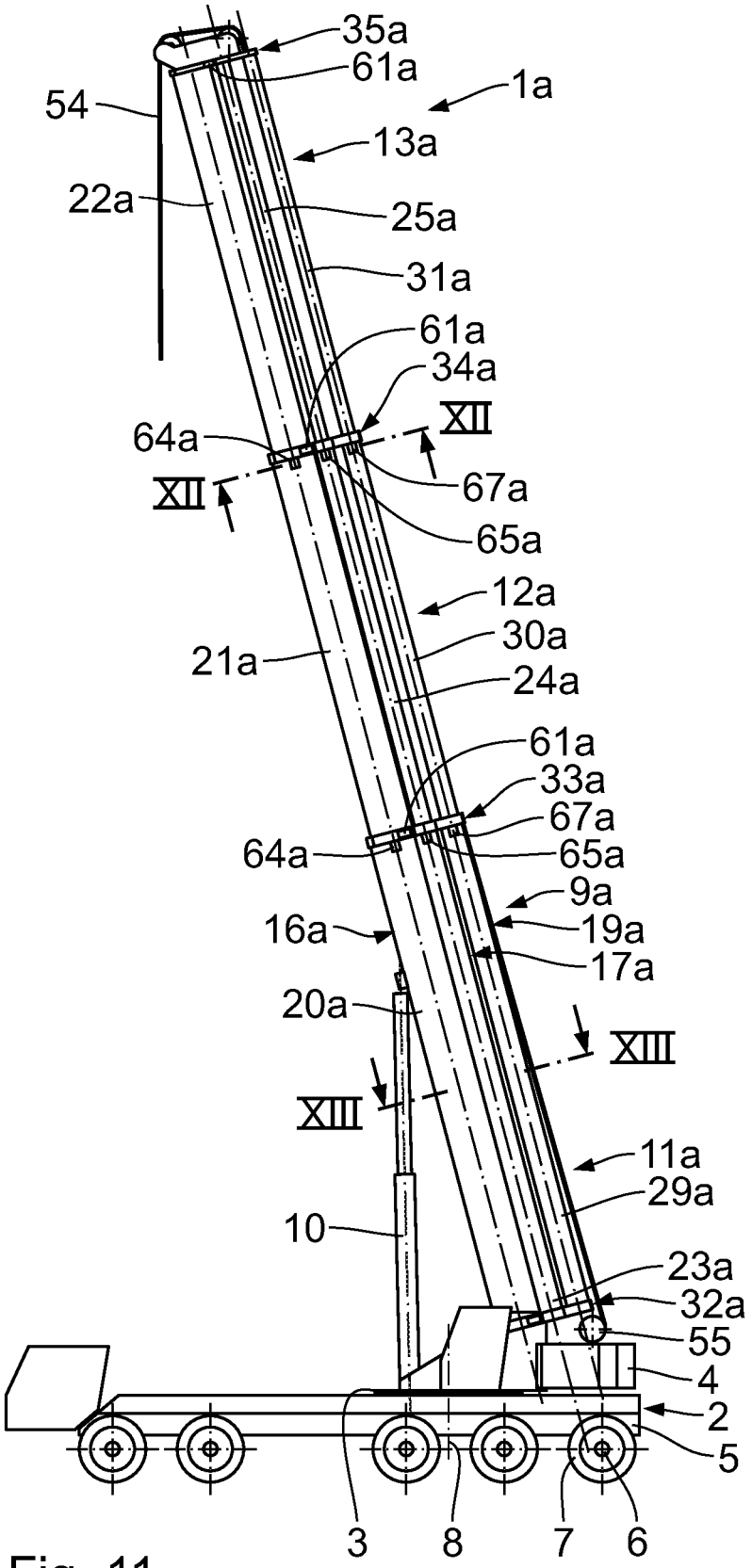
FIG. 11 shows a side view of the mobile telescopic crane in FIG. 10.
Figure 12:
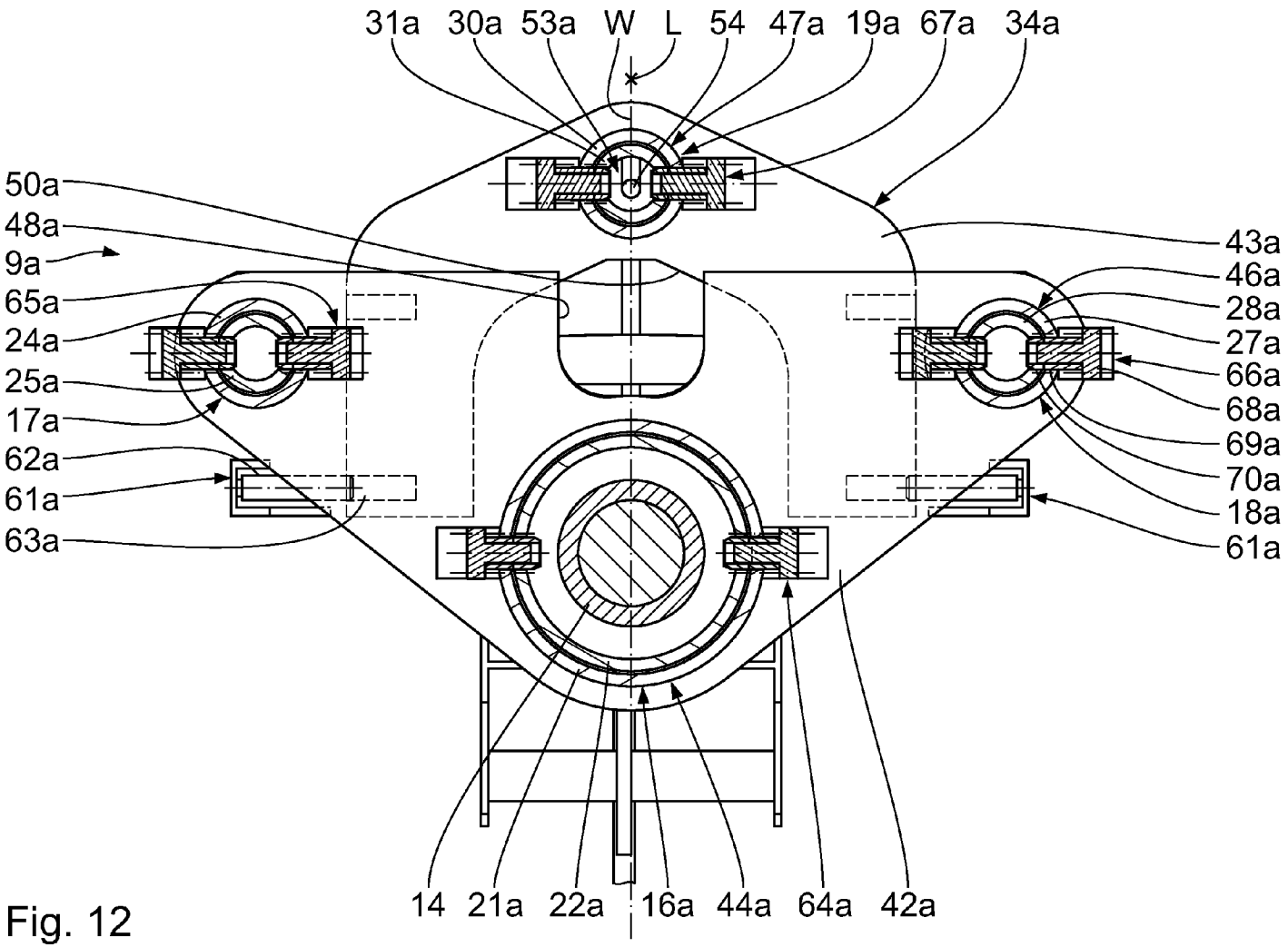
FIG. 12 shows a cross-section through the jib 10 along the section line XII-XII in FIG. 11.
Figure 13:
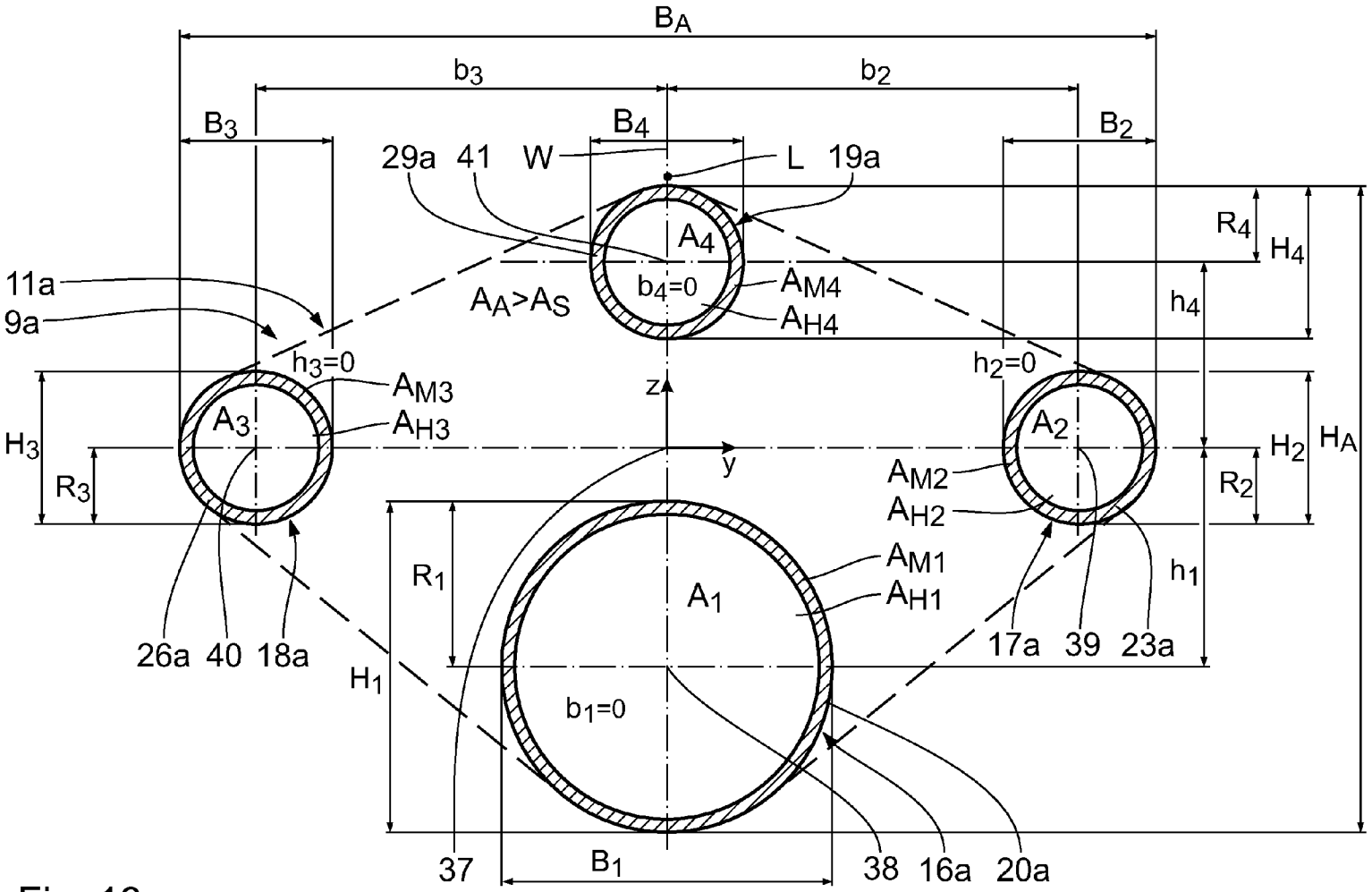
FIG. 13 shows a cross-section through the jib along the section line XIII-XIII in FIG. 11.

The lower part-jibs 16, 17 facing the undercarriage 2 form a lower side of the jib 9, whereas the upper part-jibs 18, 19 remote from the undercarriage 2 form an upper side of the jib 9. The jib 9, perpendicular to the luffing plane W, has a width B, which, proceeding from the lower part-jibs 16, 17 increases in the direction of the upper part-jibs 18, 19 up to a maximum width $B_A$. This is illustrated in FIG. 7.

The part-jib portions 20 to 31 are configured as hollow cylinders and have a circular cross-section. FIG. 7 illustrates the cross-sectional form of the part-jib portions 20, 23, 26 and 29 of the first jib portion 11 and the position of these part-jib portions 20, 23, 26 and 29 relative to one another and to the luffing plane W. The part-jib portions 20 and 23 have the same external radii $R_1$ or $R_2$, which are greater than the same external radii $R_3$ and $R_4$ of the part-jib portions 26 and 29. The part-jib portions 20, 23 parallel to the luffing plane W therefore have a height $H_1=2\cdot R_1$ or $H_2=2\cdot R_2$ and, perpendicular to the luffing plane W, a width $B_1=2\cdot R_1$ or $B_2=2\cdot R_2$. Accordingly, the part-jib portions 26 and 29 have associated heights $H_3=2\cdot R_3$ and $H_4=2\cdot R_4$ and associated widths $B_3=2\cdot R_3$ and $B_4=2\cdot R_4$. The jib 9 therefore has, in the region of the jib portion 11, a height, or a maximum height, $H_A$, which is produced from the sum of $R_1$, $R_3$, $h_1$ and $h_3$. Furthermore, in the region of the jib portion 11, the jib 9 has a width, or a maximum width $B_A$, which is produced from the sum of $R_3$, $R_4$, $b_3$ and $b_4$. The same is produced for the jib portions 12 and 13, the external radii $R_1$ to $R_4$ being correspondingly smaller because of the telescopic ability of the jib 9. To telescope the jib 9, respective part-jib portions 20 to 31, which are adjacent in the longitudinal direction L, of each part-jib 16 to 19, are guided so as to be displaceable into one another. There applies to the ratio of the width $B_A$ to each of the widths $B_i$ wherein i=1 to 4: $B_A/B_i\geq1.5$, in particular $B_A/B_i\geq2$, and in particular $B_A/B_i\geq2.5$. Furthermore, there applies to the ratio of the height $H_A$ to each of the heights $H_i$ wherein i=1 to 4: $H_A/H_i\geq1.5$, in particular $H_A/H_i\geq2$, and in particular $H_A/H_i\geq2.5$. The same applies to the jib portions 12 and 13.

The jib portions 20, 23, 26 and 29, perpendicular to the luffing plane W, have part-cross-sectional areas $A_1$ to $A_4$, which are, in each case, produced from the circular area with the associated external radius $R_1$ to $R_4$. The part-cross-sectional areas $A_i$ therefore in each case comprise the associated material cross-sectional areas $A_{Mi}$ and the cavity cross-sectional areas $A_{Hi}$ limited by the material, wherein there applies i=1 to 4. Owing to the spaced apart arrangement of the part-jibs 16 to 19 or the part-jib portions 20, 23, 26 and 29, the jib 9, in the region of the jib portion 11, has a cross-sectional area $A_A$, which is greater than a sum $A_S$ of the part-cross-sectional areas $A_1$ to $A_3$. The cross-sectional area $A_A$ is illustrated in FIG. 7 by the dotted lines, which in each case run tangentially between adjacent part-jib portions 20, 23, 26 and 29. The dotted lines together with the part-jib portions 20, 23, 26 and 29 form a peripheral line of the jib portion 11. The peripheral line limits the cross-sectional area $A_A$. Speaking figuratively, the cross-sectional area $A_A$ is produced in that a cable forming the peripheral line is tightly tensioned about the part-jib portions 20, 23, 26 and 29. The same applies to the jib portions 12, 13.

To the ratio of the cross-sectional area $A_A$ to the sum $A_S$ of the part-cross-sectional areas $A_1$ to $A_4$ there applies: $A_A/A_S>1$, in particular $A_A/A_S\geq1.5$, in particular $A_A/A_S\geq2$, in particular $A_A/A_S\geq2.5$, in particular $A_A/A_S\geq3$, and, in particular $A_A/A_S\geq4$. The same applies to the jib portions 12 and 13, wherein it is to be taken into account that the part-jib portions 21, 24, 27 and 30 or 22, 25, 28 and 31, because of the telescopic ability, correspondingly have smaller radii $R_1$ to $R_4$.

Owing to this construction, the jib 9, in comparison to conventional jibs, has a higher area moment of inertia $I_{z,tot}$ or $I_{y,tot}$ in relation to bending forces acting perpendicular to the luffing plane W and in the luffing plane W. The area moment of inertia $I_{z,tot}$ with respect to bending forces acting perpendicular to the luffing plane W, in other words upon a bend about the z-axis, is produced as:

$$I_{z,tot} = \sum_{i=1}^{n} [I_{z,i} + b_i^2 \cdot A_{Mi}], \quad (1)$$

wherein i is a continuous index for the part-jibs, $I_{z,i}$ is the part-jib i's own proportion, $b_i$ is the spacing of the centroidal axis or centre longitudinal axis of the part-jib i from the centroidal line or centre longitudinal axis of the jib in the y-direction, $A_{Mi}$ is the material cross-sectional area of the part-jib i, $b_i^2 \cdot A_{Mi}$ is the Steiner proportion of the part-jib i and n is the number of part-jibs.

For the equation (1) there also applies n=4. Equation (1) describes the achievable area moment of inertia $I_{z,tot}$ in an ideally flexurally rigid jib 9. In the practical dimensioning of the jib 9, a reduction ratio $\alpha$ is to be taken into account in the Steiner proportions and depends on the number of connecting elements 32 to 35 and their degree of flexural rigidity.

Accordingly, the area moment of inertia $I_{y,tot}$ with respect to bending forces acting parallel to the luffing plane W, in other words at a bend about the y-axis is produced as:

$$I_{y,tot} = \sum_{i=1}^{n} [I_{y,i} + h_i^2 \cdot A_{Mi}], \quad (2)$$

wherein i is a continuous index for the part-jibs, $I_{y,i}$ is the part-jib i's own proportion $h_i$ is the spacing of the centroidal axis or centre longitudinal axis of the part-jib i from the centroidal line or centre longitudinal axis of the jib in the z-direction, $A_{Mi}$ is the material cross-sectional area of the part-jib i, $h_i^2 \cdot A_{Mi}$ is the Steiner proportion of the part-jib i and n is the number of part-jibs.

Corresponding with equation (1), a reduction ratio $\beta$ is to be taken into account in equation (2) in the Steiner proportions.

The area moments of inertia are a measure of the rigidity of the jib 9 relative to the respective bending forces. Because of the Steiner fractions, the area moments of inertia are substantially increased relative to conventional jibs.

The connecting elements 32 to 36 are substantially configured from a lower plate facing the undercarriage 2 or a lower connecting element part 42 and an upper plate remote from the undercarriage 2 and an upper connecting element part 43, which are displaceable relative to one another in the direction of the luffing plane W and can be fixed to one another. The connecting elements 33 to 36 in each case have four through-openings 44 to 47 for the part-jib portions 20 to 31 of the part-jibs 16 to 19, the through-openings 44, 45 for the part-jibs 16, 17 in each case being formed in the lower plate 42 and the through-openings 46, 47 for the part-jibs 18, 19 in each case being configured in the upper plate 43. The lower plates 42 in each case have recesses 48, 49 which face the upper part-jibs 18, 19 and in which the upper part-jibs 18, 19 can be at least partially received. Accordingly, the upper plates 43 in each case recesses 50, 51, which face the lower part-jibs 16, 17 and in which the lower part-jibs 16, 17 can be at least partially received. Furthermore, the connecting elements 32 to 36 in each case have a through-opening 52 formed through the respective plates 42, 43, which through-openings form a cable guide channel 53 to guide a support cable 54. The support cable 54 is guided in the conventional manner from the free end of the jib 9 to a cable winch 55 arranged on the superstructure 3. The support cable 54 is guided on the free end of the jib 9 over two deflection rollers 56, 57, which are rotatably mounted on the free end of the jib 9 by means of a support frame 58.

Figure 6:
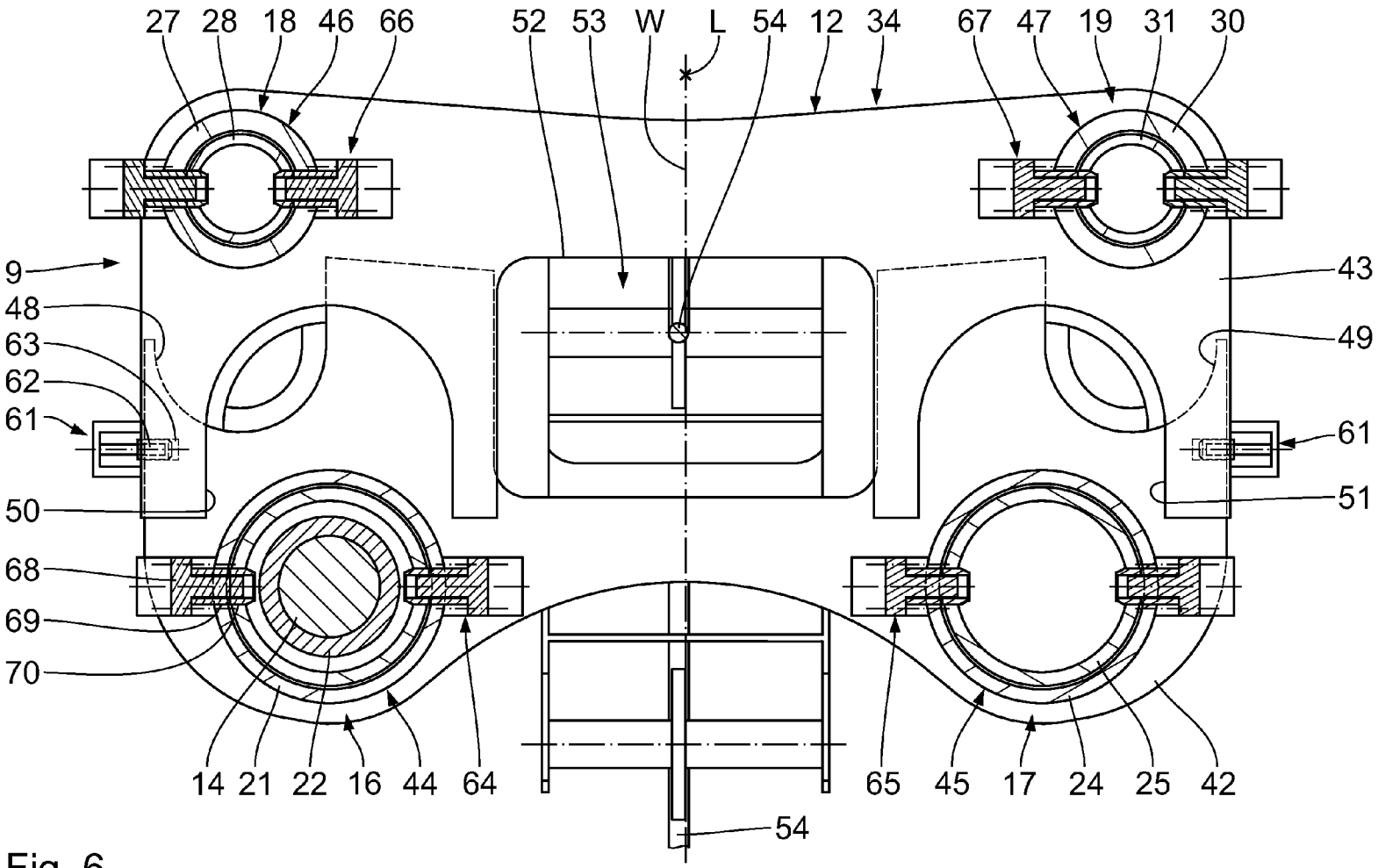
FIG. 6 shows a cross-section through the jib along the section line VI-VI in FIG. 5.

The part-jibs 18 and 19 can be displaced relative to the part-jibs 16 and 17 parallel to the luffing plane W. For this purpose, two hydraulic cylinders 59 are rigidly arranged on the end of the part-jib portions 20 and 23 facing the superstructure 3 and connected to the upper plate 43 of the connecting element 32. Accordingly, two hydraulic cylinders 60 are fastened to the part-jib portions 20 and 23 at the end and connected to the upper plate 43 of the connecting element 33. To displace the part-jibs 18, 19 or to fix these part-jibs 18, 19 relative to the part-jibs 16, 17, locking units 61 are provided. Two respective locking units 61 are arranged on a respective upper plate 43. FIG. 6, for example, shows the locking units 61 belonging to the connecting element 34. Each locking unit 61 has a locking bolt 62, which can be guided for locking or unlocking into an associated locking bore 63. The respective locking bolt 62 can, for example, be actuated hydraulically, pneumatically or electromechanically. The respective guide bolt 62 is displaceably mounted on the respective upper plate 43, whereas the associated locking bore 63 is configured in the associated lower plate 42. Two associated locking bores 63 are configured in the respective lower plate 42 for each locking bolt 62 and are used for locking or unlocking the plates 42, 43 in a retracted transporting position and an extended operating position of the jib 9. The locking units 61 are arranged on each of the connecting elements 32 to 35 and also on the connecting element 36.

The jib 9 can be transferred from a transporting position into an operating position and vice versa by the hydraulic cylinders 59, 60 and the locking units 61. In the transporting position, the cross-sectional area $A_A$ or the height $H_A$ of the jib 9 is reduced in comparison to the operating position, so the mobile telescopic crane 1 has a smaller overall height. The reduction in the overall height is necessary, for example, in order to not exceed a maximum permissible height in road traffic.

To lock the jib portions 11 to 13 in the longitudinal direction L, locking units 64 to 67 are furthermore provided, which are arranged in the region of the connecting elements 33 and 34. The locking units 64 to 67 are mounted or fastened directly on the respective associated connecting element 33, 34, so adjacent part-jib portions 20 and 21, 21 and 22, 23 and 24, 24 and 25, 26 and 27, 27 and 28, 29 and 30 and 30 and 31 are mechanically lockable at the end with respect to one another. The locking units 64 to 67 in each case have two opposingly arranged locking bolts 68, which can be guided through respective associated locking bores 69, 70. The locking bolts 68 can, for example, be actuated hydraulically, pneumatically or electromechanically.

Figure 2:
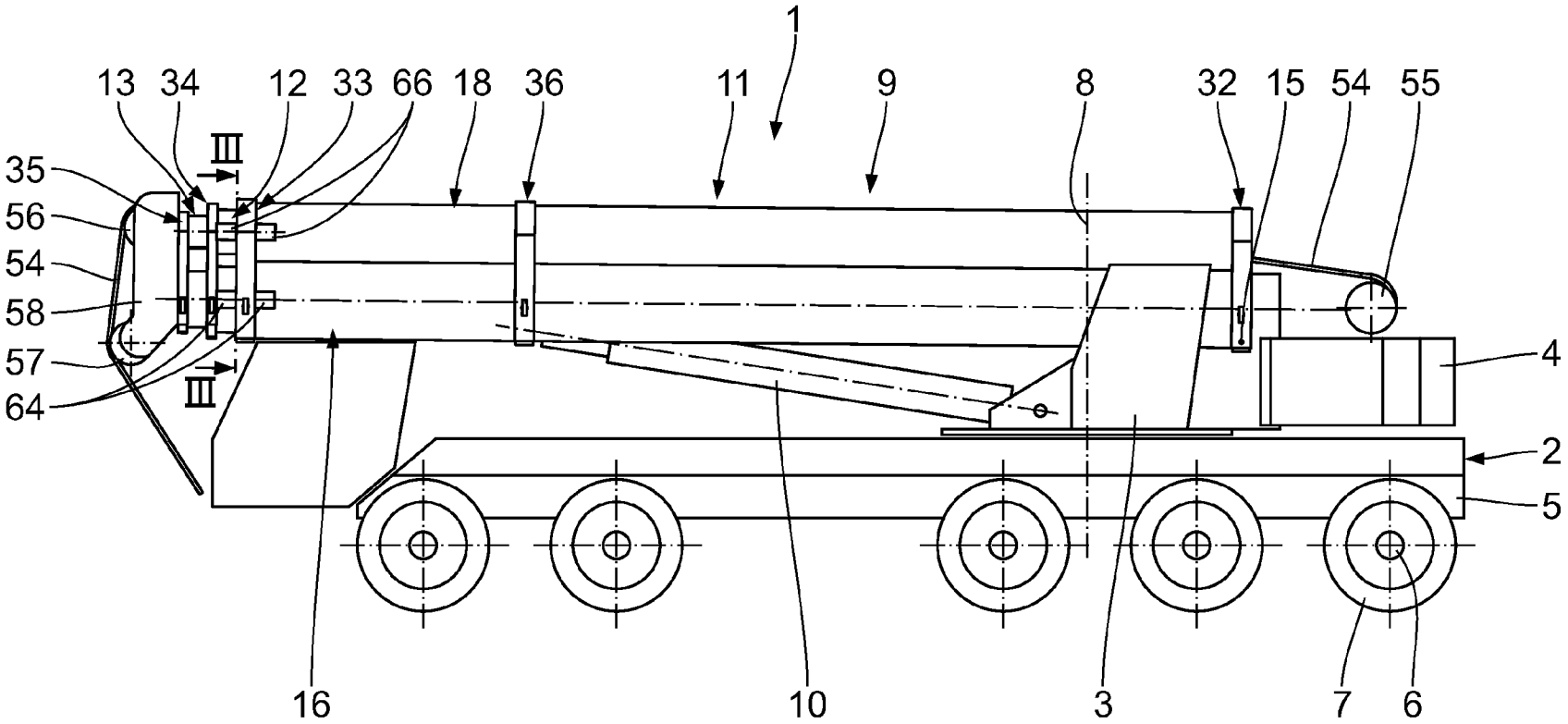
FIG. 2 shows a side view of the mobile telescopic crane in FIG. 1.
Figure 3:
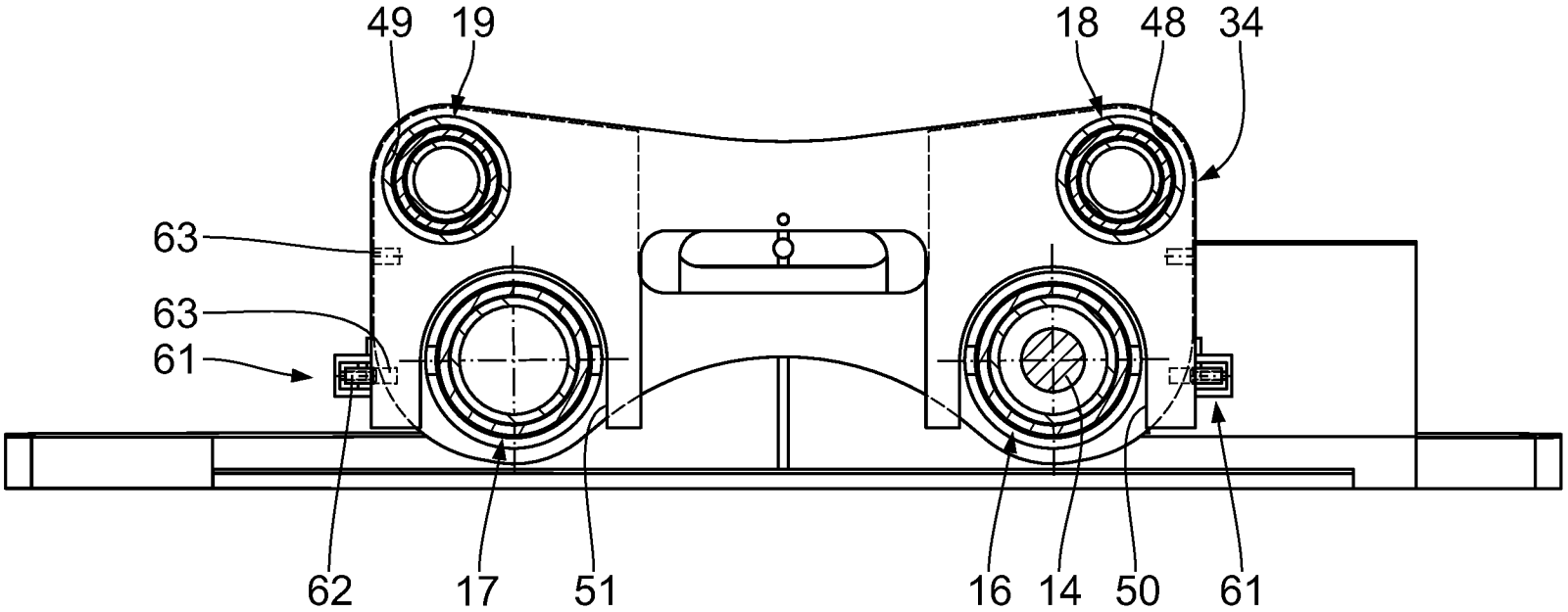
FIG. 3 shows a cross-section through the jib along the section line III-III in FIG. 2.

FIGS. 1 to 3 show the mobile telescopic crane 1 in the state provided for travelling operation. The jib 9 is located in a completely retracted transporting position. The locking units 64 to 67 are unlocked and the jib portions 11 to 13 are retracted telescopically. Furthermore, the part-jibs 18 and 19 are completely lowered by means of the hydraulic cylinders 59, 60, so the part-jibs 18, 19 are arranged in the recesses 48, 49 and the part-jibs 16, 17 are arranged in the recesses 50, 51.

In this state, the mobile telescopic crane 1 has the smallest possible overall height, so the maximally permissible height in road traffic is not exceeded. FIG. 3 illustrates the transporting position of the jib 9 with the aid of a cross-section 3 through the jib portion 13.

By means of the hydraulic cylinders 59, 60, the part-jibs 18, 19 and the upper plates 43 of the connecting elements 32 to 36 are extended relative to the part-jibs 16, 17 and the lower plates 42 of the connecting elements 32 to 36 parallel to the luffing plane W. The locking units 61 belonging to the connecting elements 32 to 36 are then locked, so the lower and upper plates 42, 43 of the connecting elements 32 to 36 are fixed with respect to one another.

Figure 4:
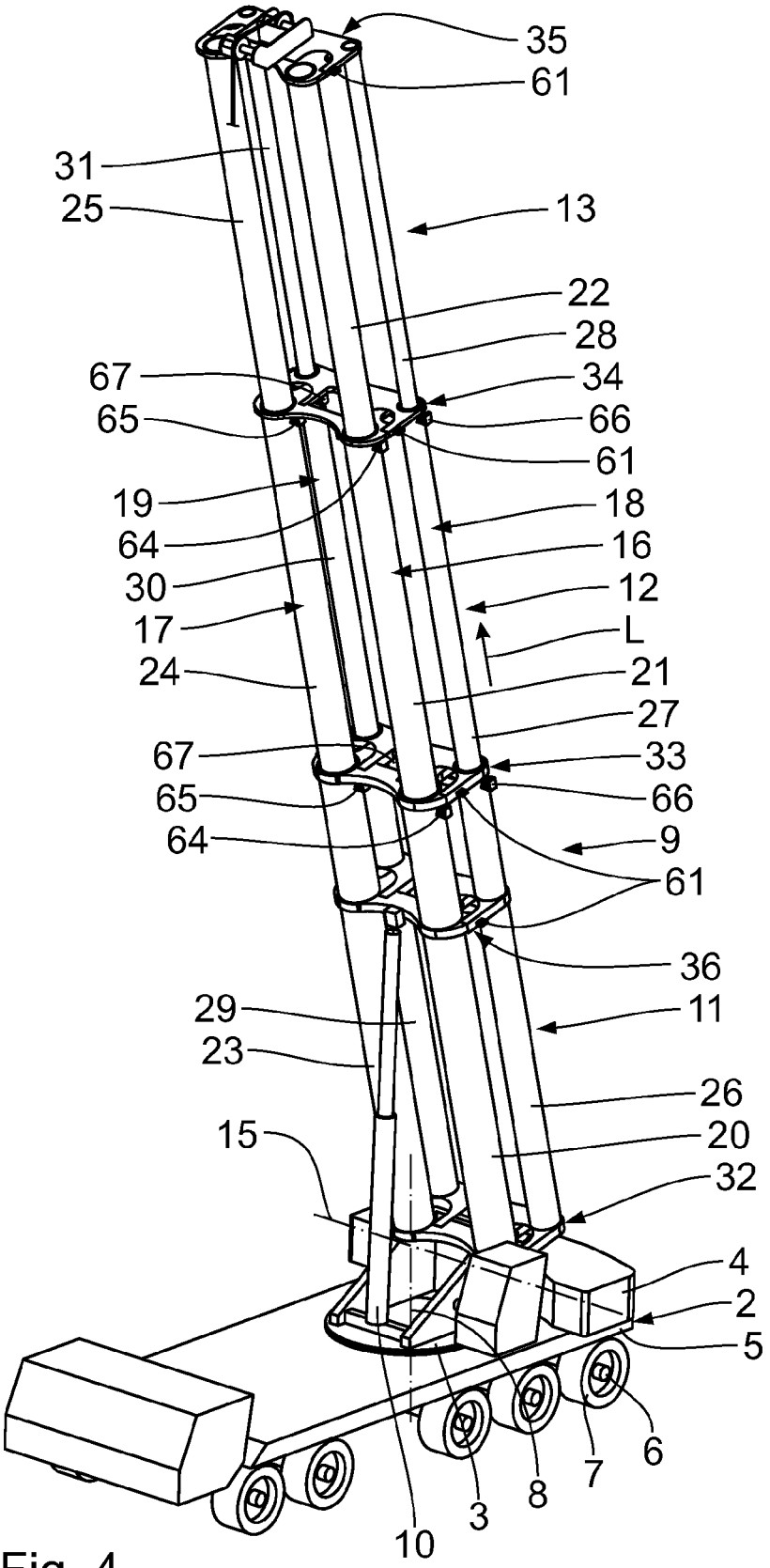
FIG. 4 shows a perspective view of the mobile telescopic crane in FIG. 1 with the jib located in an extended operating position.
Figure 5:
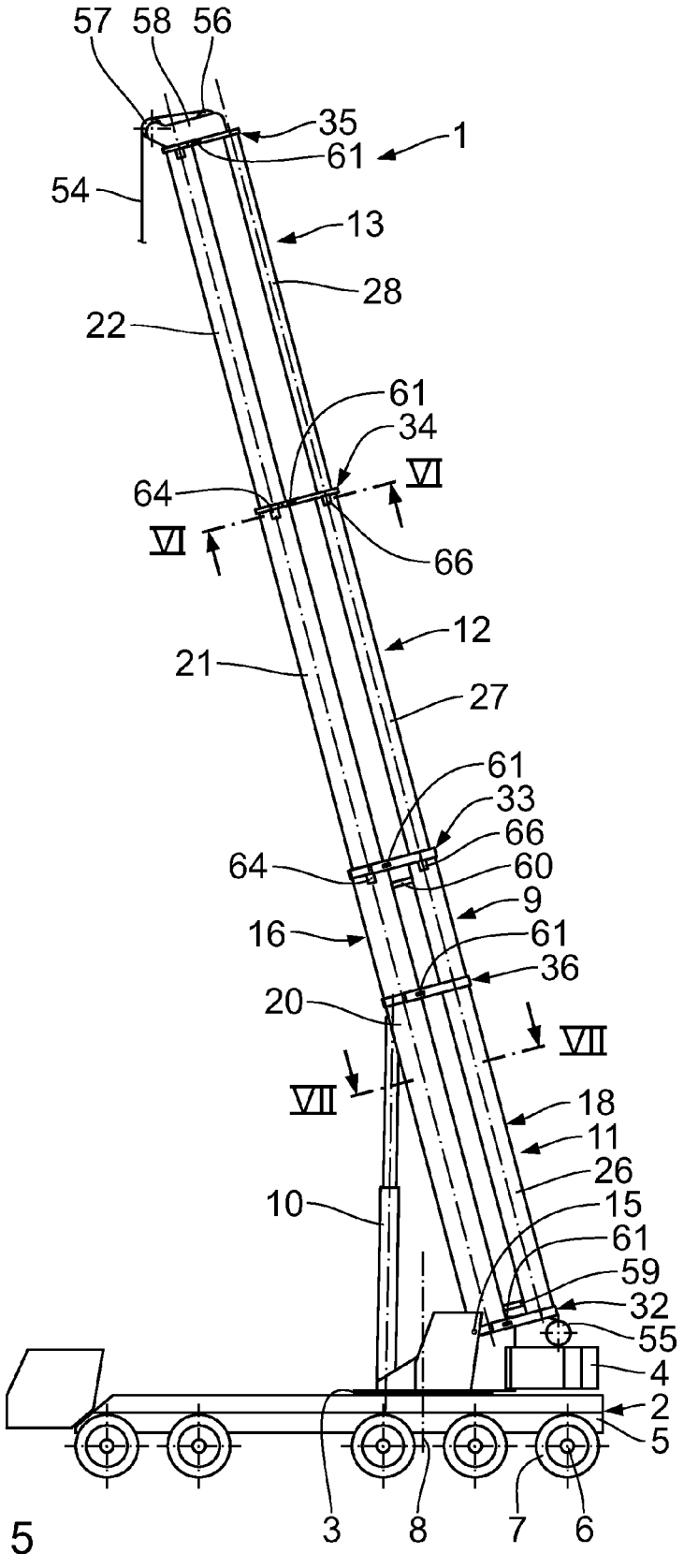
FIG. 5 shows a side view of the mobile telescopic crane in FIG. 4.

The jib 9 is thereupon erected by means of the hydraulic cylinder 10 in the luffing plane W and telescopically extended by means of the hydraulic cylinder 14. FIGS. 4 and 5 show the mobile telescopic crane 1 in an operating position with the completely erected and telescopically extended jib 9. In this state, the locking units 64 to 67 belonging to the connecting elements 33 and 34 are also mechanically locked, so the jib 9 has a high degree of rigidity. FIG. 6 shows a cross-section through the locking units 64 to 67 belonging to the connecting element 34.

The jib 9 according to the invention, because of the high area moments of inertia, has a high degree of rigidity relative to bending forces perpendicular to and parallel to the luffing plane W. As a result, in relation to the weight of the jib 9, a substantial bearing load increase can be achieved. In particular, the jib 9, even without a weight increase compared to conventional jibs or with only a slight weight increase, has a significant bearing load increase, which approximately corresponds to that of a conventional jib with anchoring supports. However, no separate transportation and no laborious assembly are necessary compared to a conventional jib with anchoring supports.

A second embodiment of the invention will be described below with the aid of FIGS. 8 to 13. In contrast to the first embodiment, the part-jibs 16*a* to 19*a* of the jib 9*a* are arranged in the form of a kite. The part-jib 16*a* faces the undercarriage 2 and is arranged in the luffing plane W. There applies $b_1=0$. In contrast, the part-jibs 17*a* and 18*a* are arranged on a side of the part-jib 16*a* remote from the undercarriage 2 and spaced apart from the luffing plane W. There applies $b_2=b_3$ and $h_2=h_3$. There applies, in particular, $h_2=h_3=0$. The part-jib 19*a* is in turn arranged on a side of the part-jibs 17*a* and 18*a* remote from the undercarriage 2 and in the luffing plane W. There applies $b_4=0$. The part-cross-sectional areas $A_2$ to $A_4$ of the part-jibs 17*a* to 19*a* are of equal size, so there applies: $A_2=A_3=A_4$. The part-cross-sectional area $A_1$ of the part-jib 16*a* is greater than the respective part-cross-sectional area $A_2$ to $A_4$. The part-jibs 16*a* to 19*a* have a circular cross-section. The jib 9*a* therefore has, in the region of the jib portion 11*a*, a maximum height $H_A$, which is produced from the sum of $R_1$, $h_1$, $h_4$ and $R_4$. Furthermore, the jib 9*a*, in the region of the jib portion 11*a*, has a maximum width $B_A$, which is produced from the sum of $R_2$, $b_2$, $b_3$ and $R_3$. The receiving space formed by the part-jib 19*a* is used as a cable guide channel 53*a*.

The lower plates 42*a* of the connecting elements 33*a* to 35*a* in each case have a centrally arranged recess 42*a*, in which the uppermost part-jib 19*a* can be received. In contrast, the upper plates 43*a* in each case have a centrally arranged recess 50*a*, in which the lower part-jib 16*a* can be received. The uppermost part-jib 19*a* can be displaced relative to the further part-jibs 16*a* to 18*a* in accordance with the first embodiment and can be fixed in the retracted transporting position and the extended operating position by means of the locking units 16*a*.

With regard to the ratio of the cross-sectional area $A_A$ to the sum $A_S$ of the part-cross-sectional areas $A_1$ to $A_4$ and to the ratio of the height $H_A$ to the respective height $H_1$ to $H_4$ and the ratio of the width $B_A$ to the respective width $B_1$ to $B_4$, the statements with regard to the first embodiment apply accordingly. To the first area moment of inertia $I_{z,tot}$ in relation to bending forces acting perpendicular to the luffing plane W there applies the equation (1), wherein n=4 and $b_1=b_4=0$, accordingly. There applies to the area moment of inertia $I_{y,tot}$ in relation to bending forces acting parallel to the luffing plane W the equation (2) wherein n=4, accordingly. The reduction ratios $\alpha$ and $\beta$ are in turn to be taken into account for the Steiner proportions.

With regard to the further construction and the further mode of functioning of the mobile telescopic crane 1, in particular the jib 9*a* and the jib portions 11*a* to 13*a* and the part-jib portions 20*a* to 31*a* and the associated locking units 64*a* to 67*a* including the locking bolts 68*a* and the associated locking bores 69*a*, 70*a*, reference is made to the first embodiment.

Figure 14:
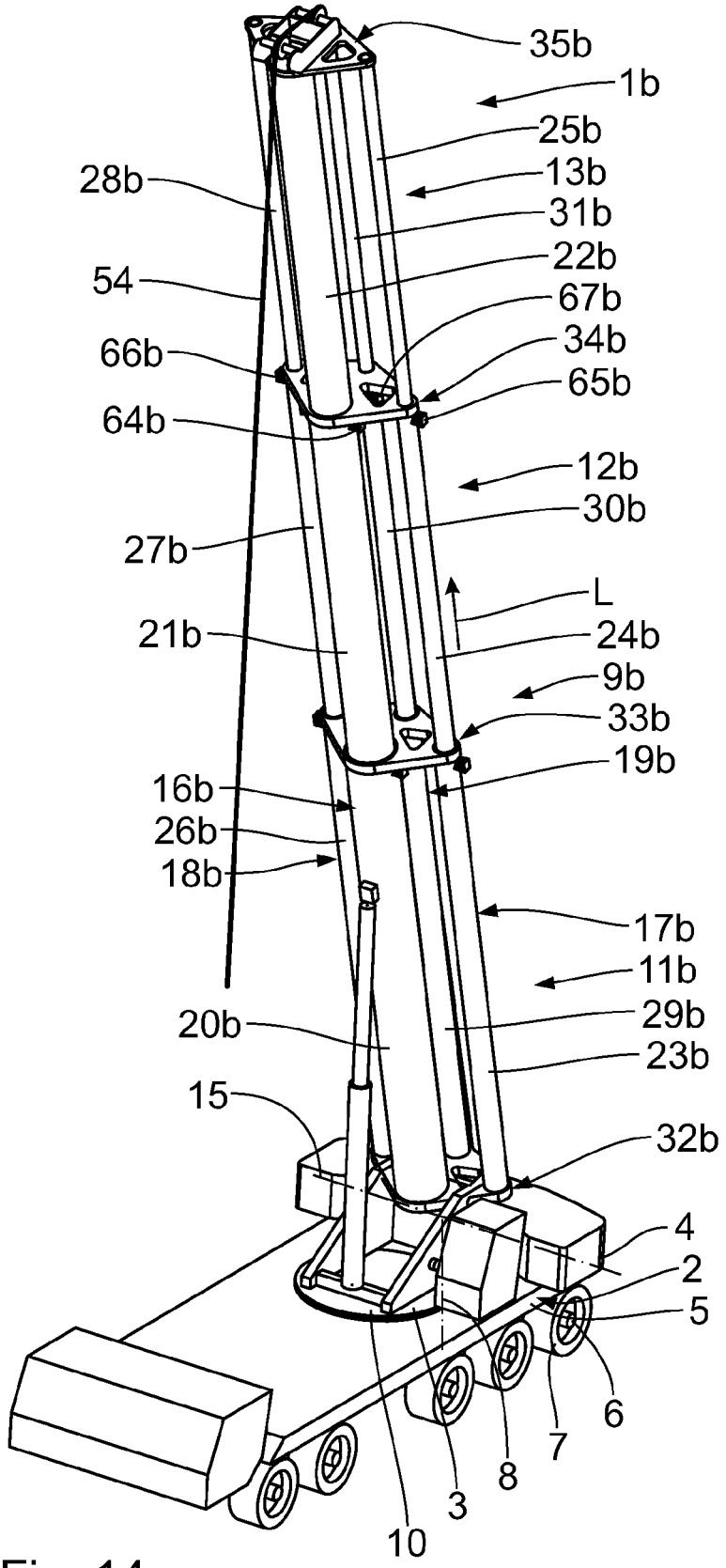
FIG. 14 shows a perspective view of a mobile telescopic crane according to a third embodiment with a jib, which is constructed from four part-jibs and is in an extended operating position.
Figure 15:
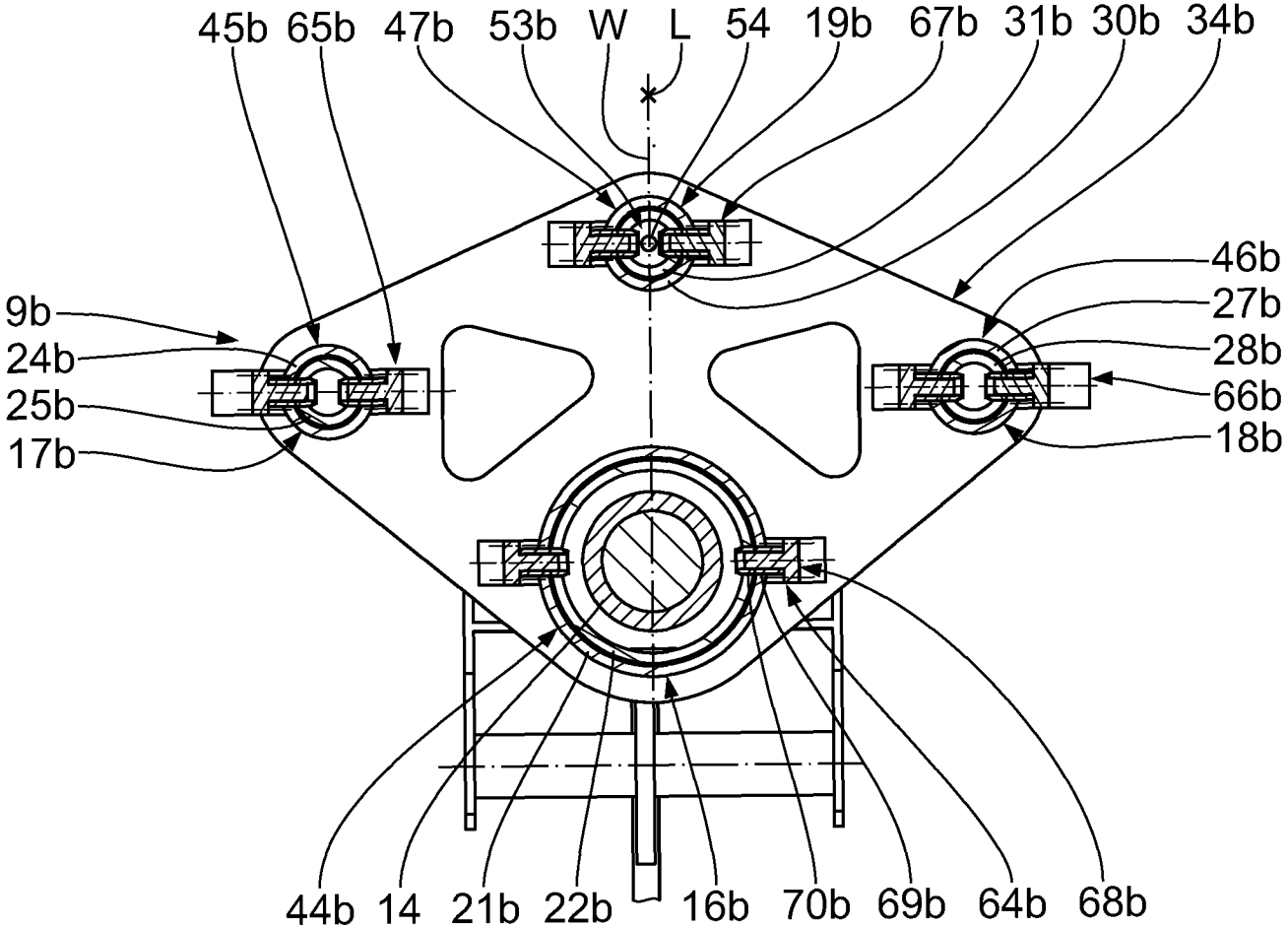
FIG. 15 shows a cross-section through the extended jib in FIG. 14 in the region of a first jib portion.

A third embodiment of the invention will be described below with the aid of FIGS. 14 and 15. In contrast to the second embodiment, the part-jib 19*b* is rigidly arranged on the part-jibs 16*b* to 18*b* by means of the connecting elements 32*b* to 35*b* and not displaceable relative thereto. As long as the maximally permissible height of the mobile telescopic crane 1*b* is not exceeded by this, a simplification of the construction of the jib 9*b* is possible in this manner. Since the connecting elements 32*b* to 35*b* are rigidly arranged on the part-jib 19*b* and are not constructed from plates which can be displaced relative to one another, the hydraulic cylinders 59*a*, 60*a*, the recesses 48*a* and 50*a* and the locking units 61*a* with the locking bolts 62*a* and the associated locking bores 63*a* can be dispensed with. The receiving space formed by the part-jib 19*b* serves as a cable guide channel 53*b*.

Moreover, the jib 9*b* and the jib portions 11*b* to 13*b* and the part-jib portions 20*b* to 31*b* and the associated locking units 64*b* to 67*b* including the locking bolts 68*b* and the associated locking bores 69*b*, 70*b* are configured in accordance with the second embodiment.

With regard to the further construction and the further mode of functioning, reference is made to the description of the preceding embodiments.

The features of the jibs 9 to 9*b* can basically be combined in any way to form a jib according to the invention. Apart from the simple increasing of the bearing load by increasing the area moments of inertia, the jibs 9 to 9*b* according to the invention have further advantages compared to a conventional jib with anchoring supports. The jibs 9 to 9*b* according to the invention, in each jib portion 11 to 13*b*, can be optimized separately with respect to the acting bending forces, so these are continuously absorbed along the jib 9 to 9*b* and not only at the end of the jib. Moreover, both the transfer of the jibs 9 to 9*b* into the operating position and their operation are extremely simple. In particular, no laborious control of the pretensioning force of the anchoring cables is necessary, so the operation is simplified and the reliability is simultaneously increased, as no incorrect control of the pretensioning force is possible. A large number of optimizing parameters are provided by means of the number of part-jibs 16 to 19*b* and their arrangement and spacing with respect to one another, whereby the cross-sectional area $A_A$ is defined, and by means of the cross-sectional form and the part-cross-sectional areas A, so a jib 9 to 9*b* according to the invention can be optimized with respect to the capacity to absorb bending forces acting perpendicular to and in the luffing plane W and with respect to the weight. In total, the jibs 9 to 9*b* according to the invention allow a substantial increase in the bearing load at a predefined weight compared to conventional jibs. In particular, with the same bearing load, substantially easier handling of the jibs 9 to 9*b* is possible with respect to transportation and assembly or transfer into the operating position compared with conventional jibs with anchoring supports.

What is claimed is:

1. A mobile telescopic crane comprising:

a movable undercarriage, a superstructure rotatably arranged on the undercarriage, a jib mounted on the superstructure, said jib being telescopic in a longitudinal direction L, and pivotable in a luffing plane, said telescopic jib comprising at least four parallel part-jibs, each of the parallel part-jibs comprising at least two part-jib portions that are telescopic in the longitudinal direction L, each of the two part jib portions having at least one flexurally rigid connecting element connecting the parallel part-jibs together, wherein each of the part-jibs are arranged at a spacing from one another transverse to the longitudinal direction L by the at least one flexurally rigid connecting element, and wherein the part-jibs are arranged polygonally with respect to one another.

2. A mobile telescopic crane according to claim 1, wherein the jib, perpendicular to the luffing plane, has a cross-sectional area $A_A$ produced by the at least four part-jibs and the sum of the cross-sectional area of the four part-jibs, perpendicular to the luffing plane, has a part-cross-sectional area $A_S$, and wherein $A_A/A_S>1$.

3. A mobile telescopic crane according to claim 1, wherein the jib, perpendicular to the luffing plane, has a width $B_A$ and each of the part-jibs has a width $B_i$, and wherein $B_A/B_i \geq 1.5$.

4. A mobile telescopic crane according to claim 1, wherein the jib, parallel to the luffing plane, has a height $H_A$ and each of the part-jibs has a height $H_i$, and for each of the part jibs, $H_A/H_i \geq 1.5$.

5. A mobile telescopic crane according to claim 1, wherein the part-jibs are arranged symmetrically with respect to the luffing plane.

6. A mobile telescopic crane according to claim 1, wherein at least one part-jib is displaceable to change the cross-sectional area $A_A$ with respect to at least one other part-jib.

7. A mobile telescopic crane according to claim 1, wherein at least one part-jib is displaceable to change a height $H_A$ of the jib with respect to at least one other part-jib.

8. A mobile telescopic crane according to claim 1, wherein respective adjacent part-jib portions are mechanically lockable with respect to one another in the longitudinal direction.

9. A mobile telescopic crane according to claim 1, wherein the part-jib portions of all the part-jibs are configured as hollow cylinders and adjacent part jib portions are telescopeable into one another.

10. A mobile telescopic crane according to claim 1, wherein the part jib portions of all the part-jibs have a geometrically similar cross-section.

11. A mobile telescopic crane according to claim 1, wherein respective adjacent part jib portions of all the part-jibs are mechanically lockable with respect to one another in the longitudinal direction.

12. A mobile telescopic crane according to claim 1, wherein at least two adjacent part jib portions are mechanically lockable with respect to one another by means of at least one locking bolt.

13. A mobile telescopic crane according to claim 1, wherein at least two adjacent part jib portions are mechanically lockable with respect to one another by means of at least two locking bolts.

14. A mobile telescopic crane according to claim 1, wherein the jib has a width that changes perpendicular to the luffing plane, and wherein the width measured at a certain distance along the longitudinal direction L increases proceeding from at least one lower part-jib facing the undercarriage up to at least two upper part-jibs remote from the undercarriage measured at the same certain distance along the longitudinal direction L.

15. A mobile telescopic crane according to claim 1, wherein respective adjacent part-jib portions of at least one part-jib are mechanically lockable with respect to one another at an end.

16. A mobile telescopic crane according to claim 1, wherein respective adjacent part-jib portions of at least one part-jib are mechanically lockable with respect to one another at an end, at least one locking bolt being provided to lock adjacent part-jib portions with respect to one another, said at least one locking bolt being arranged on an associated connecting element.

17. A mobile telescopic crane according to claim 1, wherein at least one lower part-jib facing the undercarriage measured a certain distance along the longitudinal direction L has a larger part-cross-sectional area in comparison to part-jibs remote from the undercarriage measured the same certain distance along the longitudinal direction L.

18. A mobile telescopic crane according to claim 1, wherein at least one part-jib forms a receiving space, in which a hydraulic cylinder is arranged to telescope the jib.

19. A mobile telescopic crane according to claim 1, wherein the jib comprises four part-jibs, wherein said four part-jibs are arranged polygonally and symmetrically with respect to the luffing plane.

20. A mobile telescopic crane according to claim 1, wherein a cable guide channel is formed between the part-jibs.

21. A mobile telescopic crane according to claim 1, wherein a support cable is guided along the jib.

22. A mobile telescopic crane according to claim 1, wherein a support cable is arranged in a cable guide channel.

23. A mobile telescopic crane comprising:

a movable undercarriage;

a superstructure rotatably arranged on the undercarriage;

a jib arranged on the superstructure, said jib being telescopic in a longitudinal direction and pivotable in a luffing plane;

at least four part-jibs comprising the telescopic jib, wherein each of the part-jibs is constructed from at least two part jib portions which are telescopic in the longitudinal direction, wherein said part jib portions are arranged at a spacing from one another transverse to the longitudinal direction; and, at least one flexurally rigid connecting element connecting said part jib portions together to form a jib portion;

wherein the jib, parallel to the luffing plane, has a height $H_A$ and each of the part-jibs has a height $H_i$, and wherein $H_A/H_i \geq 1.5$.

24. A mobile telescopic crane comprising:

a movable undercarriage;

a superstructure rotatably arranged on the undercarriage;

a jib arranged on the superstructure and pivotable in a luffing plane, said jib being telescopic in a longitudinal direction;

at least four part-jibs comprising the telescopic jib;

each of the part-jibs comprising at least two part-jib portions that are telescopic in the longitudinal direction;

wherein each of the part jib portions are arranged at a spacing from one another transverse to the longitudinal direction and form a jib portion with at least one flexurally rigid connecting element; and, wherein the jib has a cross-section width perpendicular to the luffing plane, and wherein said width increases from at least one lower part jib facing the undercarriage up to at least two upper part-jibs remote from the undercarriage.

* * * * *